United States Patent [19]

Beaussant

[11] Patent Number: 4,741,332

[45] Date of Patent: May 3, 1988

[54] EQUIPMENT FOR PROTECTING PERSONNEL FROM CONTAMINATION

[75] Inventor: Raymond Beaussant, Bretigny, France

[73] Assignee: Intertechnique, France

[21] Appl. No.: 777,544

[22] Filed: Sep. 19, 1985

[51] Int. Cl.[4] ..... A62B 17/04; A62B 18/00

[52] U.S. Cl. ..... 128/201.23; 128/201.25; 128/201.28; 128/202.27; 128/205.12; 128/205.24; 128/205.25.204.26

[58] Field of Search ..... 128/201.15, 201.21–201.23, 128/201.25, 201.28, 201.29, 202.11, 204.25, 204.26, 205.12, 205.25

[56] References Cited

U.S. PATENT DOCUMENTS

| | | | |
|---|---|---|---|
| 2,824,557 | 2/1958 | Mejean et al. | 128/201.28 |
| 3,103,927 | 9/1963 | Henneman et al. | 128/201.28 |
| 3,152,589 | 10/1964 | Kugler | 128/201.21 |
| 3,179,119 | 4/1965 | Fitt et al. | 137/81.1 |
| 3,186,406 | 6/1965 | Fitt et al. | 128/201.21 |
| 3,314,307 | 5/1967 | Nicastro | 128/201.21 |
| 3,672,384 | 6/1972 | Hellquist | 128/202.11 |
| 4,172,455 | 10/1979 | Beaussant | 128/201.23 |
| 4,336,590 | 6/1982 | Jacq et al. | 364/418 |
| 4,409,969 | 9/1983 | Cresswell et al. | 128/201.28 |
| 4,549,541 | 10/1985 | Sundahl | 128/201.29 |

FOREIGN PATENT DOCUMENTS

| | | | |
|---|---|---|---|
| 0153247 | 8/1985 | European Pat. Off. | 368/297 |
| 1031138 | 5/1958 | Fed. Rep. of Germany | 37/141 T |
| 436540 | 10/1935 | United Kingdom | 128/201.28 |

*Primary Examiner*—William E. Kamm
*Assistant Examiner*—Karin N. Reichle
*Attorney, Agent, or Firm*—Larson and Taylor

[57] ABSTRACT

A protective breathing equipment for a crew member of an aircraft comprises a demand regulator supplied with pressurized oxygen and with dilution air taken from the living space of the crew. The regulator is connected to a breathing mask for the crew member. A protective hood supplied with filtered ventilation air is provided for location over the head of the crew member. The regulator has a housing containing the regulating mechanisms and an intake for dilution air and is surrounded by a case defining a protective space about the housing. The space is fed with filtered air under an overpressure of the same order as that which prevails in the hood.

11 Claims, 2 Drawing Sheets

EQUIPMENT FOR PROTECTING PERSONNEL FROM CONTAMINATION

FIELD OF THE INVENTION

The invention relates to equipment for protecting personnel in an environment likely to present contamination of nuclear, biological or chemical origin, frequently called NBC protection equipment.

The invention is particularly, but not exclusively, suitable for use on board aircraft capable of operating at high altitudes, which compels the personnel on board to wear a breathing mask fed by a demand regulator.

PRIOR ART

Protective breathing equipment exists which comprises a demand regulator supplied with pressurized breathing gas from a source (generally an oxygen source) and with dilution air taken from the living space of the personnel and connected to a breathing mask to be carried by a wearer and a protective hood supplied with filtered ventilation air and arranged for being pulled on over the wearer's head.

In that prior art equipment, a filter for retaining contaminants is placed between the regulator and the mask. This filter is in the form of a flat cylindrical housing of large diameter, carried on the chest of the person to be protected. This solution presents serious deficiencies. The size of the chest filter considerably hinders the wearer to the point of reducing his capacities of action, particularly in a fighter aircraft. The pressure head loss impressed by the filter constitutes an inspiratory hindrance further aggravated by the counter pressure on expiration due to the overpressure necessarily maintained in the hood with respect to the surrounding space. Since the regulator is placed upstream of the filter, it may be contaminated and decontamination thereof is difficult.

Finally, most breathing equipment of the above type in present use includes, as a filtered air source, a rotary blower placed inside the cabin. Such a blower is cumbersome. Only high cost blowers offer the required reliability.

It would seem at first sight that the construction which has just been described was the only one possible, since locating the filter upstream of the regulator would cause a potential risk of contamination due to air leaks towards the internal zones of the regulator which would then be at a pressure lower than the environment. Modifications of the regulator would also be required.

OBJECT OF THE INVENTION

It is an object of the invention to provide protection in an NBC environment while reducing the hindrances caused to the wearer of the equipment to a minimum and avoiding contamination of the regulator.

SUMMARY OF THE INVENTION

To this end, the invention provides equipment of the above-defined type whose regulator further comprises a case defining a protective space about a housing containing the regulator mechanism, said housing having an intake for dilution air, and said space being fed with filtered air under an overpressure of the same order of magnitude as that which prevails in the hood via a tapping into the means supplying the hood with filtered air.

The supply means typically comprise an ejector placed in the cabin, whose primary fluid is air from a compressor stage of a propulsion jet engine, from an auxiliary power unit (APU), even from an oxygen storage, more especially an emergency oxygen supply; the secondary air is taken from the cockpit atmosphere through NBC filter means and the ejector is designed to supply air at a pressure higher than that in the cockpit. The overpressure will frequently be between 5 and 15 mbars and may lead to an overpressure of a few mbars in the hood and the case of the regulator.

The invention will be better understood from the following description of a particular embodiment of the invention, given by way of example.

SHORT DESCRIPTION OF THE DRAWINGS

DETAILED DESCRIPTION OF THE INVENTION

Figure 1:
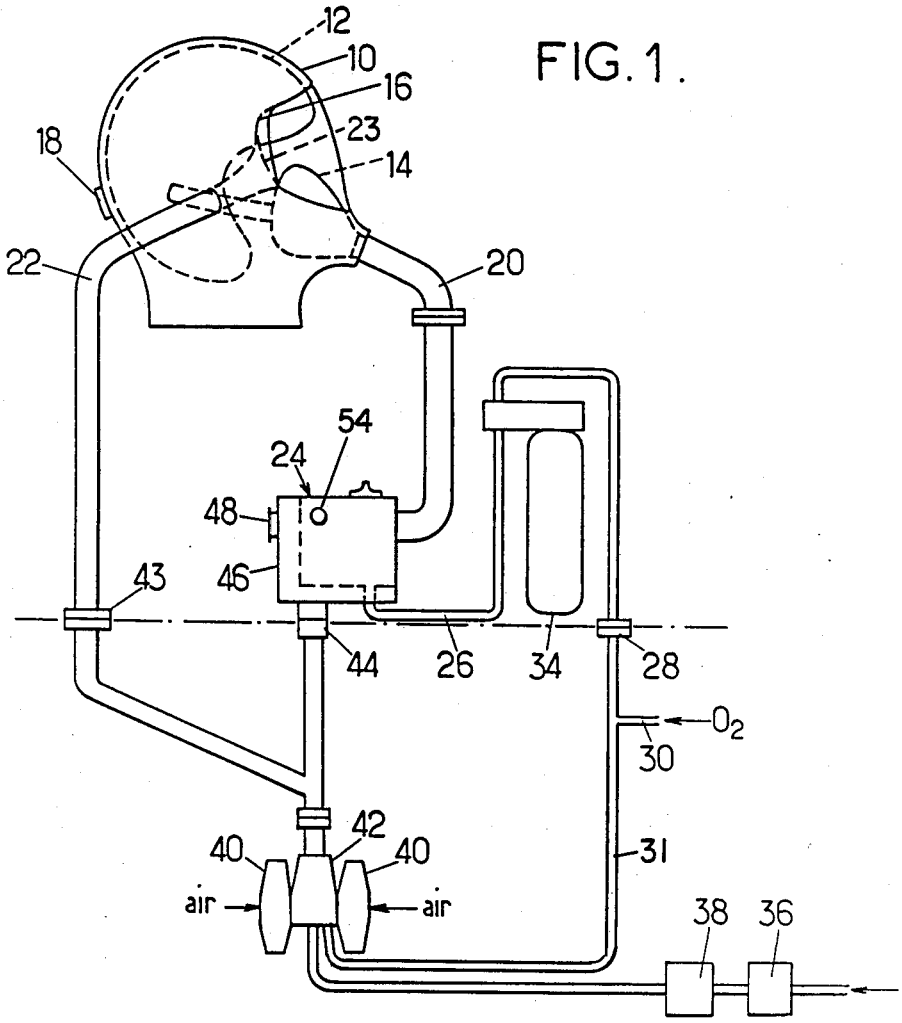
FIG. 1 shows schematically protective equipment according to one embodiment of the invention, intended for a fighter aircraft pilot and a modification thereof.

Referring to FIG. 1, the equipment comprises a hood 10 intended to be pulled by the pilot over his helmet 12 and his breathing mask 14. Hood 10 is provided with a transparent eyepiece 16 and, preferably, a discharge valve 18 which determines the overpressure prevailing in the hood or, at least, limits it. The hood further comprises an intake fitting for the intake pipe 20 of mask 14 and a duct 22 supplying ventilation air, ending in a fish tail diffuser 23 which distributes the air over the eye piece 16 so as to prevent the formation of mist.

The intake pipe 20 of the mask is connected upstream to a demand regulator 24 fed by a source of pressurized breathing gas. As shown in FIG. 1, the source comprises a duct 26 fixed to the seat of the pilot, connected by a tear away connection 28 to an intake duct 30 from a liquid oxygen converter. The seat also carries an emergency oxygen cylinder 34 which takes over from the converter in the case of a fault in the supply by the latter, for example, in the case of pilot ejection.

Hood 10 and regulator 24 are provided with a filtered air supply under a slight overpressure with respect to the atmosphere of the living space. A fraction of the supply air is taken, at a pressure of a few bars, from the compressor of a jet engine of the aircraft, from an auxiliary power unit or from any other source (not shown). This air passes successively through an oil and water retention filter 36 and a filter 38 retaining contaminants of chemical, bacteriological and/or radioactive origin (NBC filter). This air forms the primary gas for an ejector 42 which sucks in the rest of the air required for dilution and ventilation. When it is desired to have an emergency supply, ejector 42 is supplied with primary air via line 31. The secondary air is taken from the atmosphere of the living space, through two NBC filters 40.

The air which leaves the ejector, at a pressure greater than that of the living space, through tear away connections 44 and 43, supplies both the case of regulator 24 and hood 10.

Figure 2:
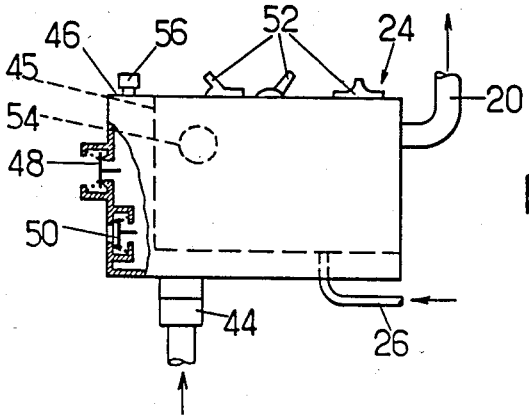
FIG. 2 is a simplified elevational view showing the case of an oxygen regulator usable with the equipment of FIG. 1 in partial cross-section.

Regulator 24 (FIG. 2) comprises regulating mechanisms carried by a housing 45 enclosed in a case 46. The mechanisms themselves will not be described for they may be of any positive pressure type. By way of example pneumatic control mechanisms such as those described in French Pat. No. 1,557,809 or electric control mechanisms as described in U.S. Pat. No. 4,336,590 may be used. But whereas, in a conventional regulator the mechanism housing is surrounded by the atmosphere of the living space, from which it takes the dilution air, in FIG. 2 the housing is subjected to an overpressure, maintained by ejector 42 and regulated by a calibrated valve 48. The same is preferably adjusted for obtaining the same overpressure in the hood and in the case of the regulator, so in the hood and the mask.

An anti-suffocation valve 50 may also be provided in the case for supplying the regulator from the living space should the intake of air from the ejector 42 cease when this intake function is provided in the regulator.

Because of the overpressure in normal operation, possible leaks, for example, along control knobs 52, occur from the inside towards the outside and cannot cause contamination of the air admitted to the mask. The input of dilution air 54 opens into the overpressurized space fed with filtered air and defined by case 46 and housing 45, so that it cannot be contaminated by air from the living space.

The regulator may be completed by a closable pressure take off 56 for checking the pressure which exists in the case.

The calibration of valves 18 and 48 will be chosen while taking into account the clothing equipment of the personnel to be protected. When the pilot is equipped with a waistcoat with an inflatable breast pocket for compensating the overpressure during aspiration, an overpressure may be adopted of about 5 mbars above the pressure in the living space. If not, an overpressure of 2 to 3 mbars may be adopted which does not hinder breathing and is sufficient for protection against polluted air intake.

Figure 3:
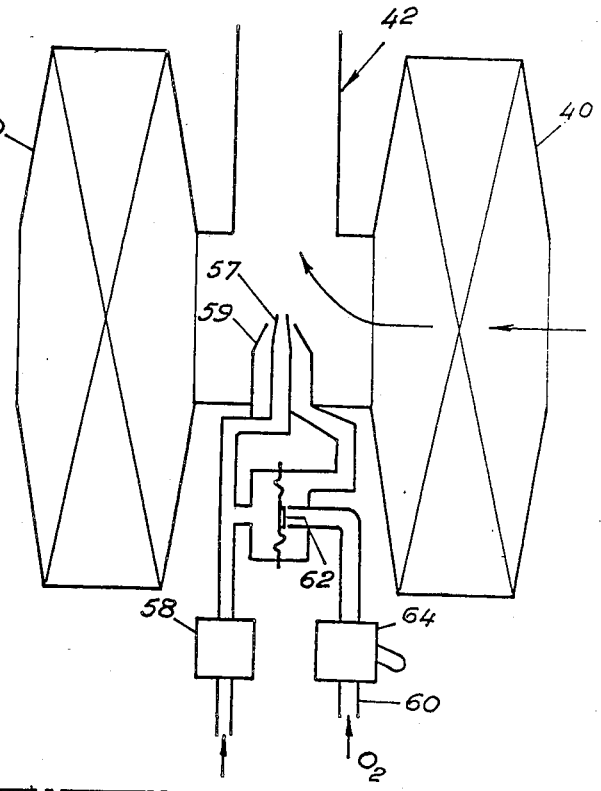
FIG. 3 is a diagram showing one possible construction of an ejector which may form the means for supplying the hood and the regulator with air, FIG. 4, similar to FIG. 3, shows a modified embodiment.
Figure 4:
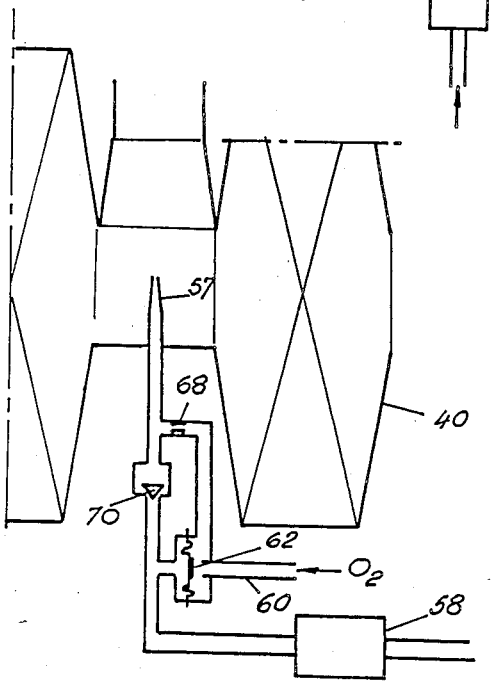

Ejector 42 may have one of the constructions shown schematically in FIGS. 3 and 4 when it is desired to have an emergency supply. Then the ejector must be connected to an additional inlet pipe 60, in FIGS. 3 and 4 and also indicated by 31 in FIG. 1.

In the case of FIG. 3, ejector 42 uses two concentric injectors. The internal injector 57 is connected to the pressurized purified air supply through a pressure limiter or pressure reducer 58. The external injector 59 is connected through a duct 60 to the oxygen supply 30. In duct 60 are interposed on the one hand, a valve 62 controlled by the output pressure of the pressure reducer 58 and, on the other, a manual control valve 64. Valve 62 is held in the closed position as long as the supply pressure of the internal injector 57 exceeds a predetermined threshold. Valve 64 is closed during normal operation (stand by) so as to avoid oxygen losses. It is manually manipulated to activate the oxygen supply. The arrangement of the two injectors may be reversed.

The ejector shown schematically in FIG. 4 (where the parts corresponding to those of FIG. 3 are designated by the same reference numbers) comprises a single injector 57. During normal operation, this injector is fed through the flow limiter or pressure reducer 58, which maintains a substantially constant injection pressure. The intake of oxygen is prevented by valve 62. Should there be an air failure, for example following a breakdown of the means supplying the pressure reducer 58, valve 62 opens under the pressure of the oxygen (arriving through a cock similar to cock 64 of FIG. 3 and not shown). A nozzle 68 limits the oxygen flow rate. Leaks of oxygen to the faulty supply are prevented by a non-return valve 70.

Whatever the embodiment used, it can be seen that the device of the invention does away with the hindrance caused by the chest filter, provides breathing comfort by corresponding calibration of the hood and regulator valves and prevents contamination of the oxygen regulator without requiring substantial modifications. The solutions using an ejector, i.e. a static part, are more reliable than those using a small size blower. It is, nevertheless, possible to use a blower, Such a blower may be outside the living place and consequently room is available for a blower which may be of large size and may be more reliable. Finally, the device of the invention may be readily adapted to ensure a supply redundance guaranteeing safety.

The equipment is susceptible of numerous embodiments. Moreover, it may also be used at low altitudes, when the personnel does not need to be equipped with a breathing mask. In this case, the ejector 42 will only supply the hood.

The ventilation flow rate will as a general rule be between 50 and 75 l/mn ATPD, as will the supply flow rate to the regulator case.

I claim:

1. Protective breathing equipment comprising:

breathing mask means for donning by a wearer;

protective hood means for wearing over and encompassing the head of the wearer and the breathing mask and for preventing entrance of ambient air and overpressurizing;

a positive pressure type demand regulator having a housing provided with an inlet adapted for connection with a source of pressurized breathing gas, an outlet connected to said breathing mask and pressure regulating means in said housing for controlling flow of pressurized breathing gas from said inlet to said outlet, case means surrounding said housing and defining therewith a space surrounding said housing, and means for supplying said hood and said surrounding space with filtered air under a pressure higher than ambient pressure, said housing being provided with an inlet communicating said surrounding space and said pressure regulating means for delivering dilution air to be mixed with said breathing gas.

2. Equipment according to claim 1, wherein said case means is provided with valve means for maintaining the fluid pressure in said surrounding space substantially the same as the fluid pressure in said hood.

3. Equipment according to claim 2, wherein said valve means comprises means for maintaining the fluid pressure at approximately 5 millibars above the pressure of the ambient atmosphere surrounding the wearer when the wearer is equipped with a waistcoat with an inflatable breast pocket for compensating overpressure during aspiration.

4. Equipment according to claim 1, wherein said case means is further provided with an intake check valve for avoiding suffocation when the means for supplying said surrounding space ceases to function.

5. Equipment according to claim 1, for use in a jet aircraft, wherein said means for supplying said hood and surrounding space comprises fluid ejector means having a primary fluid inlet means adapted for connection to a compression stage of a jet engine of the aircraft and a secondary air inlet means connected to the atmosphere surrounding the wearer through filter means.

6. Equipment according to claim 5, wherein said filter means is an NBC filter means.

7. Equipment according to claim 6, further comprising an emergency supply source of pressurized oxygen and valve means connecting said emergency supply source to said ejector means, said valve means being maintained in closed condition by the pressure of air from the primary fluid inlet means.

8. Equipment according to claim 1, for use in a jet aircraft, wherein said means for supplying said hood and surrounding space comprises fluid ejector means having a primary fluid inlet means adapted for connection to an APU and a secondary air inlet means connected to the atmosphere surrounding the wearer through filter means.

9. Equipment according to claim 1, for use in a jet aircraft, wherein said means for supplying said hood and surrounding space comprises fluid ejector means having a primary fluid inlet means adapted for connection to an oxygen storage means and a secondary air inlet means connected to the atmosphere surrounding the wearer through filter means.

10. Equipment according to claim 1, for use in a jet aircraft, wherein said means for supplying said hood and surrounding space comprises fluid ejector means having a primary fluid inlet means adapted for connection to a blower located outside of a cockpit for the wearer and a secondary air inlet means connected to the atmosphere surrounding the wearer through filter means.

11. Protective breathing equipment for a crew member of a fighter aircraft, comprising:

breathing mask means for being donned by the crew member;

protective hood means to be worn by the crew member over said breathing mask and the head of the crew member and for preventing entrance of ambient air and overpressurizing;

a positive pressure type demand regulator having a housing provided with an inlet adapted for connection with a source of pressurized breathing gas, an outlet connected to said breathing mask and pressure regulating means in said housing for controlling flow of pressurized breathing gas from said inlet to said outlet, case means surrounding said housing and defining therewith a space surrounding said housing in substantially leak tight manner;

means for supplying said hood and said surrounding space with filtered air at a pressure higher than the pressure within the cockpit; said hood and surrounding space being in communication with each other, and means for maintaining substantially the same pressure in said hood and said surrounding space.

* * * * *